US006026750A

United States Patent [19]

Nelson

[11] Patent Number: 6,026,750

[45] Date of Patent: Feb. 22, 2000

[54] SHAPED CHARGE LINER WITH INTEGRAL INITIATION MECHANISM

[75] Inventor: Carl A. Nelson, St. Louis Park, Minn.

[73] Assignee: Alliant Techsystems Inc., Hopkins, Minn.

[21] Appl. No.: 09/053,165

[22] Filed: Apr. 1, 1998

[51] Int. Cl.[7] ..... F42B 12/10

[52] U.S. Cl. ..... 102/476; 102/307; 86/1.1

[58] Field of Search ..... 102/306–310, 102/476; 86/1.1, 20.1

[56] References Cited

U.S. PATENT DOCUMENTS

| | | | |
|---|---|---|---|
| 2,787,958 | 4/1957 | Brandt | 102/476 |
| 3,375,108 | 3/1968 | Wyman, Sr. et al. | 102/306 |
| 3,808,972 | 5/1974 | Cammack et al. | 102/476 |
| 4,425,850 | 1/1984 | Grossler | 102/307 |
| 4,470,353 | 9/1984 | Fogal et al. | 102/476 |
| 4,481,886 | 11/1984 | Brattstrom et al. | 102/476 |

FOREIGN PATENT DOCUMENTS

| | | | |
|---|---|---|---|
| 1200007 | 12/1959 | France | 102/476 |

OTHER PUBLICATIONS

Birkhoff, et al., "Explosives with Lined Cavities," Jun., 1948, Journal of Applied Physics, vol. 19, pp. 563–582.

Pugh, et al., "Theory of Jet Formation by Charges with Lined Conical Cavities," May, 1952, Journal of Applied Physics, vol. 23, No. 5, pp. 532–542.

Thomanek, et al., "Die Entwicklung der ausgekleideten Hohllandung, (The Development of the Lined Hollow Charge)," Explosivstoffe Nr. 8, 1960, pp. 177–179.

Held, "Evaluation of Shaped Charge Penetration Efficiency by Advanced Diagnostic Techniques," 1981, 6th Ball. Symposium.

Chou, et al., "Recent Developments in Shaped Charge Technology," 1986, Propellants, Explosives, Pyrotechnics II, 99–114.

*Primary Examiner*—Harold J. Tudor

*Attorney, Agent, or Firm*—George A. Leone; Mark Goldberg

[57] ABSTRACT

A shaped charge explosive warhead assembly is composed of a one piece shaped charge liner including an explosive initiation charge, and a main explosive charge which surrounds the shaped charge liner. The one piece shaped charge liner includes a forward thin wall section and an integral tail end section having a common longitudinal axis of symmetry. The forward thin wall section includes wall portions having a trumpet or other selected shape, and the tail end section includes a plurality of symmetrically located spoke-like apertures extending radially from the longitudinal axis of symmetry and further includes a central bore hole extending from an end surface of the tail end section and in communication with the spoke-like apertures. The spoke-like apertures and bore hole of the tail end section are filled with the explosive initiation charge. A detonator is coupled to the explosive initiation charge within the bore hole.

17 Claims, 5 Drawing Sheets

SHAPED CHARGE LINER WITH INTEGRAL INITIATION MECHANISM

FIELD OF THE INVENTION

The present invention is generally related to shaped charge explosive warheads, and more particularly to a shaped charge liner having an explosive initiation mechanism integral therewith.

BACKGROUND OF THE INVENTION

In military ordnance arts, destructive devices commonly referred to simply as "warheads," have been developed to accomplish a wide variety of military mission requirements.

A shaped charge warhead refers to a generally axially symmetric combination of components including, among others, a liner designed to collapse upon explosive detonation and form a directed-energy penetrator, an explosive material or charge, a firing or explosive initiation mechanism intended to detonate the explosive charge and thereby forcibly propel the penetrator toward a target, and a warhead housing in which the liner and explosive charge are confined before firing. A delivery vehicle commonly carries the warhead to the target.

Shaped charge warheads are based upon the hollow charge principle, which has been known since before 1800. In fact, the French charge creuse or the German Hohlladung, which mean literally "hollow charge," are more descriptive than the English. A demonstration of an ability of hollow charges to direct explosive energy was provided independently by von Foerster and Munro in the 1880s. The potential for military applications of this directed explosive energy led to extensive research during early years of the twentieth century. It was discovered that when an axially symmetric explosive charge is hollowed out at one end to form a "charge cavity", and the charge cavity placed against a metal target block, and the charge is initiated at its opposite end, a deep hole is produced in the target. In 1938 Thomanek in Germany discovered that if the cavity is lined with metal, penetration of the charge is magnified. Charges with lined cavities, commonly referred to as simply "shaped charges", were used widely during World War II. The United States "Bazooka" and the German Panzerfaust were two anti-armor weapons employing shaped charges.

The hollow charge principle may be characterized as follows. Explosive detonation products or gases, expanding into the charge cavity, converge on a central charge cavity axis due to axial symmetry. The converging gases divide into two flows, one directed forward and away from the charge, and one being directed back into the charge. Due to geometry of the converging flows and laws of mass and momentum conservation, the forward-directed gases acquire a much greater velocity than the backward-directed gases. This high velocity jet of gases strikes the target, creating a pressure high enough to erode the target material to a considerable depth.

A further refinement of the aforesaid hollow charge principle includes the addition of a metal liner in contact with the explosive charge which forms the charge cavity—i.e., the shaped charge liner is configured to mate with the formed charge cavity or more typically, the charge is formed or cast over the liner. When the charge cavity is lined with a metal liner such as copper, the same basic hollow charge principle still applies. In a lined cavity, energy of a detonated explosive is transferred to the shaped charge liner as a detonation wave sweeps over the shaped charge liner from the rear or aft portion of the shaped charge liner. The shaped charge liner is subjected to such high stresses that it begins to behave more as a fluid than as a solid. In turn, a high velocity jet is created in the same manner as described above, except that the jet consists of metal, herein referred to as a "metal jet," and is able to direct energy at a small area of an intended target. The force of the impinging metal jet is sufficient to erode a target such as armor plate, thereby creating a crater in the target, much as a garden hose deeply erodes soil if it is directed at one point for a sufficient length of time. Because of this garden hose effect similarity, this type of armor penetration is often termed "hydrodynamic."

Modern shaped charges have incorporated many refinements in design and materials, but employ the same principles outlined above. Tip velocities in excess of 9000 meters/second have been obtained with metal jets formed of copper liners, and even higher velocities can be achieved with other metals having higher sound speeds. Copper has been most widely used as a shaped charge liner material due to its ductility and consequent ability to produce very long jets.

Shaped charge liner geometry also plays an important role in determining shaped charge performance. Trumpet or horn shaped charge liners, for example, are able to produce very high metal jet tip velocities and deep penetration. Superior shaped charge explosive warhead performance requires high quality materials and precise fabrication techniques.

Research conducted on shaped charge explosive warheads of the prior art has shown that very low lateral ("drift") velocity of the jet is required to achieve deep target penetration. That is, low drift velocity maximizes the amount of metal jet material reaching the lowest point of the crater made in the target by the metal jet, which advantageously contributes to penetration depth into the target.

Drift velocity is dependent on many factors, foremost among them being explosive charge detonation wave and liner concentricity. Detonation wave concentricity in the explosive charge is primarily dependent upon the method of detonating the explosive charge, and secondarily upon the homogeneity of explosive material. The technique commonly employed in shaped charge explosive warheads is the use of a precision fabricated initiation assembly positioned concentrically on the explosive charge axis. The first element of the initiation assembly is typically a detonator containing a small amount of explosive which, upon receiving an electric current, initiates a "train" of explosive elements leading finally to main charge initiation. Each element of the explosive train is initiated by the energy released (output) from the previous element and provides sufficient energy (input) to initiate the next element in the train.

An explosive initiation train for a shaped charge warhead usually incorporates a combination of elements referred to as a precision initiation coupler (PIC)/booster. In this design, the output from the detonator initiates a small diameter column of explosive, the output from which is precisely positioned on the shaped charge axis and is sufficient to initiate a pellet referred to as the booster, also positioned concentric with the axis. Detonation wave concentricity using a PIC/booster has been difficult to achieve consistently in high volume shaped charge production, primarily because the "stackup" of tolerances normally used in fabricating the various components leads to small variations in the position (i.e. eccentricities) of the PIC/booster relative to the explosive charge and liner.

SUMMARY OF THE INVENTION

It is an object of the present invention to provide detonation wave concentricity and shaped charge liner concentricity to a high degree of precision in a shaped charge explosive warhead where the initiation mechanism is symmetrical relative to the whole assembly of explosive charge and shaped charge liner.

It is another object of the present invention to reduce jet drift induced by explosive charge initiation eccentricity in a shaped charge explosive warhead.

It is another object of the present invention to simplify shaped charge fabrication and assembly by combining PIC/booster and liner into one part.

In accordance with the present invention, a metal jet penetrator of a shaped charge explosive warhead is formed by detonation of the main explosive charge by an initiation mechanism contained within a portion of a metal liner. The novel integral fabrication or construction of the initiation mechanism and metal liner assists in creating detonation wave concentricity of the explosive charge so as to produce a highly reliable and effective warhead.

In another aspect of the present invention, a shaped charge explosive warhead is composed of a one piece shaped charge liner including an initiation mechanism, and a formed explosive charge which surrounds the shaped charge liner. The one piece shaped charge liner includes a forward trumpet section and a tail end section having a common longitudinal axis of symmetry. The forward trumpet section includes wall portions having a selected contour and thickness, and the tail end section includes a plurality of symmetrically located spoke-like apertures extending radially from the longitudinal axis of symmetry and further includes a bore hole extending from the end surface of the tail end section and in communication with the spoke-like apertures. The bore hole of the tail end section and spoke-like apertures are filled with an explosive charge, the explosive fill in the latter being made flush with the lateral surface of the tail end section. A detonator is coupled to the explosive charge within the bore hole, which acts as a precision initiation coupler (PIC) as discussed earlier. The PIC operates to ignite the explosive charge simultaneously within each of the spoke-like apertures, these apertures being flared into a conical shape at the output. The explosive contained within each of the conical volumes provides sufficient explosive energy to initiate the main explosive charge simultaneously along a ring on the surface of the tail end section.

Other objects, features and advantages of the present invention will become apparent to those skilled in the art through the description of the preferred embodiment, claims and drawings wherein like numerals refer to like elements.

DETAILED DESCRIPTION OF THE PREFERRED EMBODIMENT OF THE INVENTION

Prior Art

Figure 1:
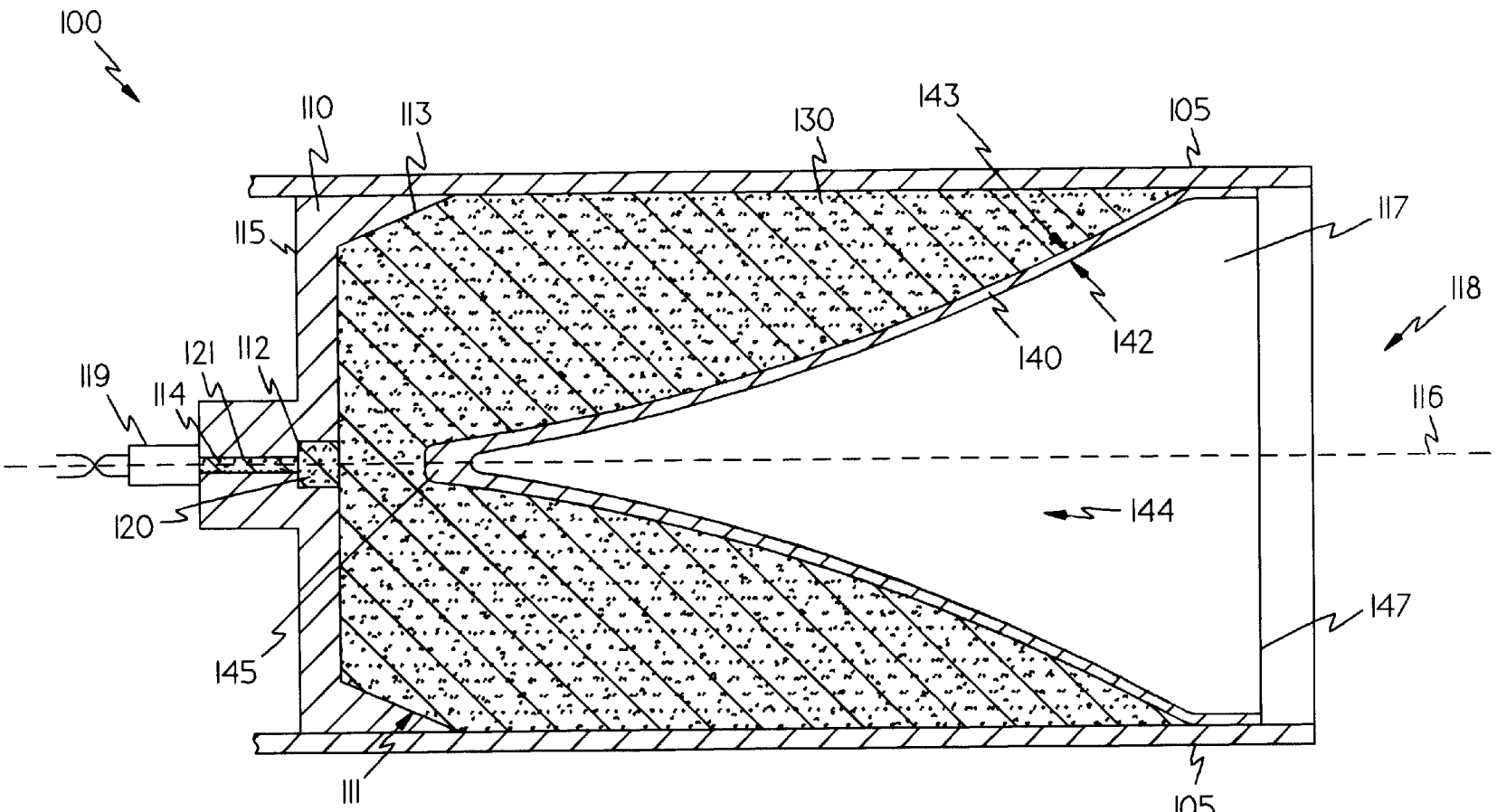
FIG-1 PRIOR ART
FIG. 1 is a cross-sectional view of a shaped charge explosive warhead of the prior art.

Illustrated in FIG. 1 is cross sectional view of a shaped charge explosive warhead munitions assembly 100 of the prior art. The shaped charge munitions assembly 100 is generally right circular cylindrically shaped and secured within a cylindrical case 105.

Shaped charge munitions assembly 100 includes an aft initiation assembly 115 containing a PIC/booster, a formed explosive charge 130, and a metal shaped charge liner 140. Explosive charge 130 is constructed so as to form a generally cone shaped "charge cavity," generally indicated by numeral 117. Liner 140 is intended to be constructed so as have cone shaped wall portions so as to mate with the charge cavity 117 defined by the shape of explosive charge 130, and also be in physical contact with explosive charge 130.

Aft initiation assembly 115 includes a forward facing surface 113 which forms an aft boundary for explosive charge 130, and is generally configured to mate with the main explosive charge surface 111 so as to provide, theoretically, concentricity with the whole main charge explosive and shaped charge liner assembled therewith. Contained in the aft initiation assembly 115 is a centrally located bore hole (PIC) 114 containing a small explosive charge 121, generally initiated by a detonator 119 in contact therewith. A cylindrical cavity 112, concentric with PIC 114 and in communication therewith is provided so as to contain the booster explosive pellet 120. As illustrated in FIG. 1, aft initiation assembly 115, explosive charge 130, shaped charge liner 140, and case 105 are configured and arranged such that a longitudinal reference axis 116 passes centrally through booster 112, PIC 114, and the axis of symmetry of the shaped liner 140 and the formed main explosive charge 130.

Liner 140 generally consists of a thin metal shell which is formed to a conical, trumpet, bell-like or other shape by a variety of techniques. Liner 140 further includes tip end 145 proximate to booster charge 120 contained within cavity 112, and in general alignment with reference axis 116. Liner 140 is also generally configured together with the explosive charge 130 such that it is theoretically concentric therewith, as measured for example by referencing the liner inner surface 142 with respect to the explosive charge surface 111.

The shaped charge explosive warhead assembly 100 as just described is well know in the art. In accordance with aforesaid hollow charge principles, the generally conically shaped charge cavity 117 formed by explosive charge 130 is configured to matingly receive the shaped charge liner 140, for example by casting or pressing the explosive charge 130 around the liner such that intimate contact is achieve therewith. During assembly of shaped charge explosive warhead assembly 100, explosive charge 130 may be pressed into a pre-billet form under a pressure of 20,000 to 25,000 p.s.i. to achieve a required full material density, then the pre-billet surface machined to final shape 111.

PIC/booster charge 120 and 121 typically comprises a well-known plastic bonded explosive referred to as PBXN-5, having a chemical composition of 95% HMX, or $C_4H_8N_8O_8$ (a high explosive molecule,) plus 5% Viton (a binder.) Explosive charge 130 commonly comprises a well-known high explosive referred to as LX-14, having a chemical composition of 95.5% HMX and 4.5% Estane (a binder.)

In operation of the shaped charge explosive warhead 100, PIC/booster charge 121/120 is ignited by a triggering device as is well known in the art, such as an exploding bridgewire (EBW) detonator generally indicated by numeral 119. Upon receiving the output from the detonator, which may not be concentric with respect to the reference axis 116 or more generally with the PIC/booster 121/120, main explosive charge 130, or shaped charge liner 140, the explosive contained within the PIC 121 is ignited, and the detonation therein travels forward within the PIC borehole 114. During this transit, the explosive detonation wavefront becomes more nearly planar such that upon reaching the booster pellet 120, the output from the PIC 121 is nearly concentric therewith and also with the main explosive charge 130 and shaped charge liner 140. The booster pellet 120 is thus ignited by the output from the PIC so as to produce a detonation that is nearly concentric with the aforesaid component, which detonation propagates in a nearly spherical wavefront. Detonation of main explosive charge 130 then acts upon liner 140 to produce the aforedescribed metal jet.

As indicated earlier, detonation wave concentricity of the explosive charge 130 is extremely important to achieve optimal target penetration by the resultant metal jet produced by the metal liner 140. Accordingly, prior art shaped charge explosive warhead assemblies are constructed so that the PIC 121, booster 120, main explosive charge 130 and shaped charge liner 140 are concentrically aligned to the extent possible given the fabrication tolerances of the aforesaid component parts. Unfortunately, in such prior art designs, the PIC/booster must be separately fabricated and centered by means of some feature other than the liner. As a result, it is not possible to consistently achieve detonation wave/liner concentricity to a high degree of precision.

The Invention

Illustrated in FIGS. 2A–E and FIG. 3 is a one piece combined shaped charge liner and initiation mechanism 200 in accordance with the present invention which functions as a shaped charge liner that overcomes the drawbacks of a shaped charge liner 140 shown in FIG. 1 of the prior art. The shaped charge liner of the invention, for the first time, incorporates an initiation mechanism integral with it, as will be subsequently described with reference to the shaped charge explosive warhead assembly 300 as particularly illustrated in FIG. 3. The construction of shaped charge liner 200 in accordance with the present invention is particularly illustrated in the differing views of FIGS. 2A–E.

Figure 3:
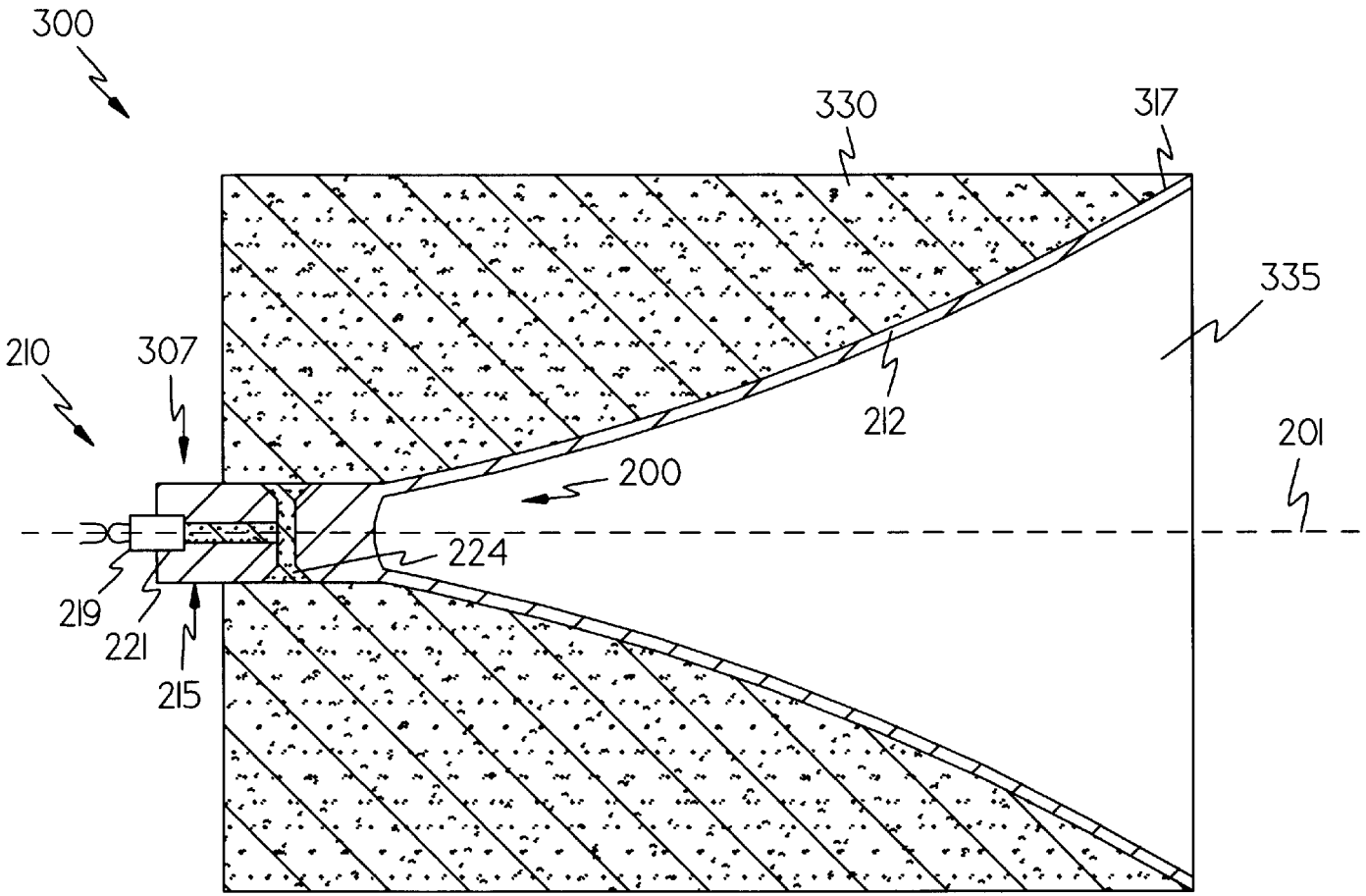
FIG. 3 is a cross-sectional view of a shaped charge warhead assembly of the present invention.

Illustrated in FIG. 3 is a cross-sectional view of a shaped charge explosive warhead assembly 300 employing shaped charge liner 200 of the present invention. Shaped charge explosive warhead assembly 300 is intended to be substituted for shaped charge warhead assembly 100. Like shaped charge explosive warhead assembly 100, shaped charge explosive warhead assembly 300 is intended to be typically, but not necessarily, cylindrically shaped so as to be accommodated by case 105. For clarity of understanding the present invention, case 105 has been omitted in FIG. 3. As particularly illustrated in FIG. 3, shaped charge explosive warhead assembly 300 of the present invention simply includes a formed main explosive charge 330 illustrated as being in the form of a right circular cylinder, and shaped charge liner 200 with an extended tail end section containing an explosive initiation mechanism.

Figure 2B:
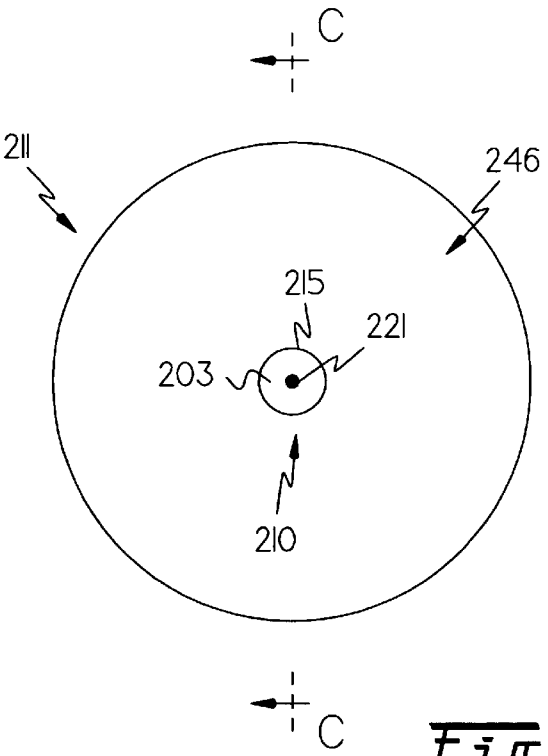
FIGS. 2A–E are differing views of a shaped charge liner of the present invention or a shaped charge warhead.
Figure 2A:
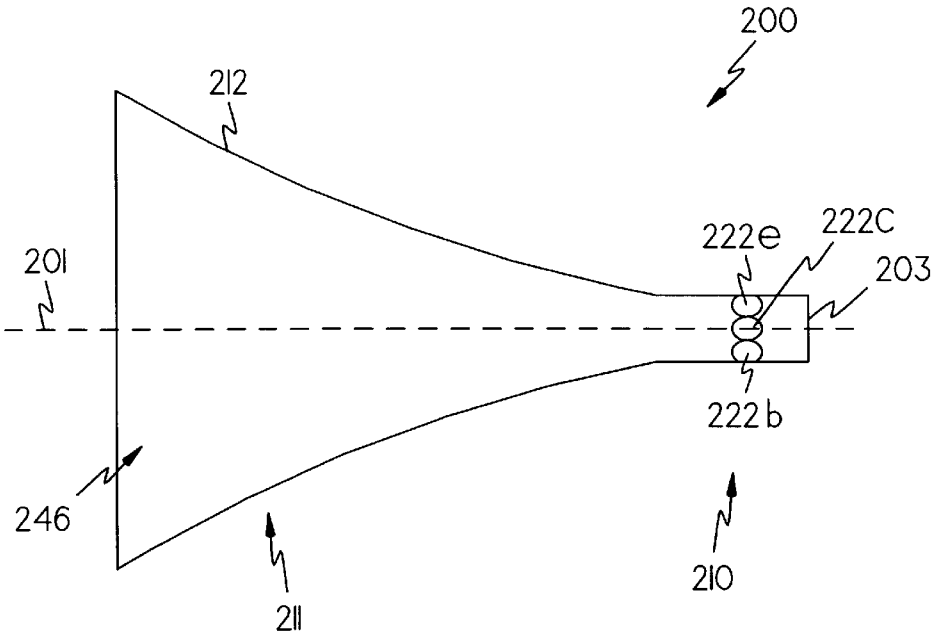
Figure 2C:
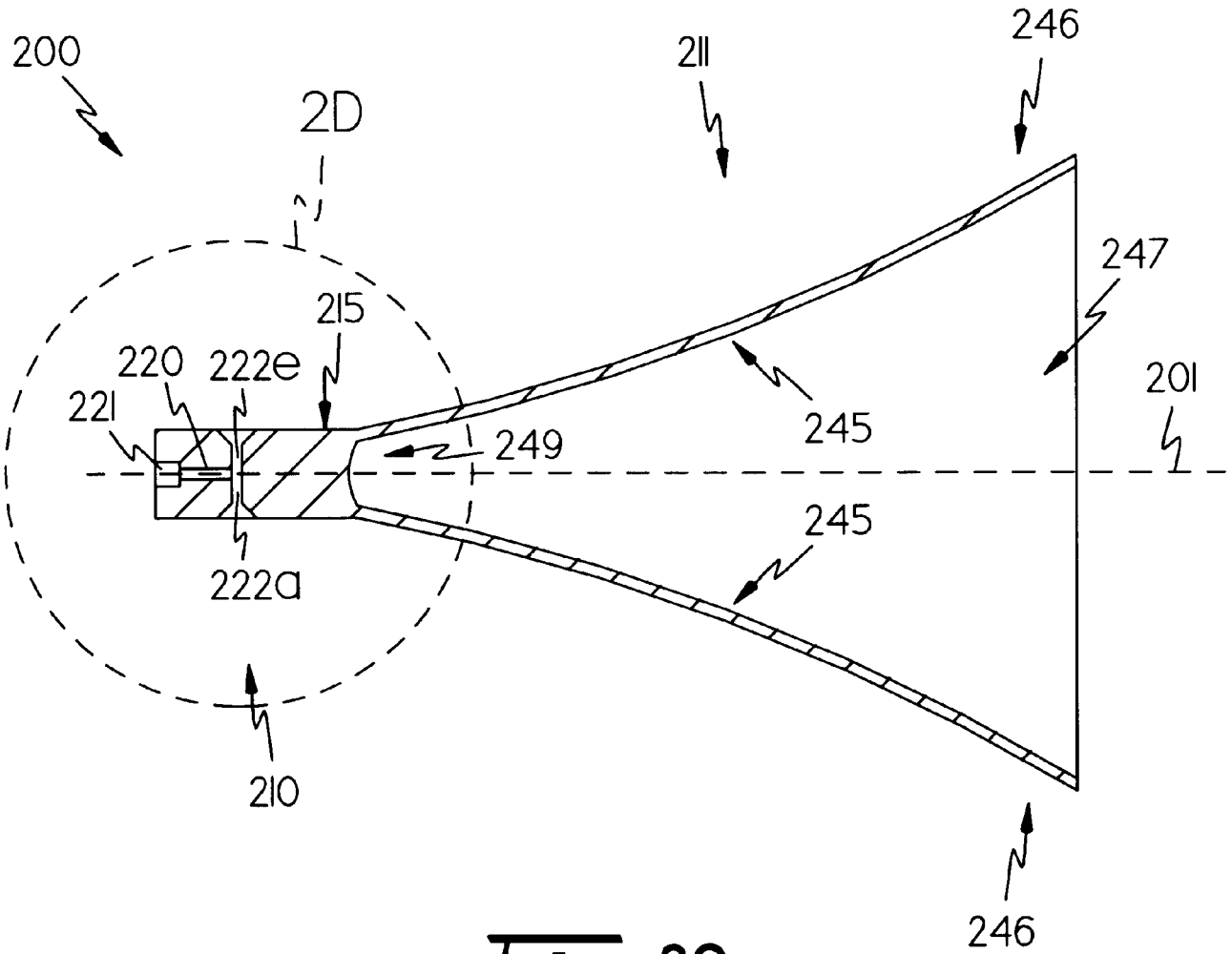

Referring now to FIGS. 2A–C, shaped charge liner 200 is generally a trumpet shaped structure as particularly depicted by the plan view of FIG. 2A showing a side view, the plan view of FIG. 2B showing an end view, and the cross sectional view of FIG. 2C as viewed from section lines C—C of FIG. 2B. The generally trumpet-like liner 200 includes a tail end section 210 and a forward trumpet section 211. Tail end section 210 is generally depicted as cylindrically shaped, and forward trumpet section 211 is depicted as being a thin wall trumpet shaped portion 212.

FIG. 2B particularly illustrates the general concentric nature of tail end section 210 and forward trumpet section 211 where the longitudinal axis of symmetry of the tail end section and the forward trumpet section 211 is aligned with central reference axis 201. At the aft end of tail end section 210 is a generally circular end surface 203. In one embodiment of the invention, liner 200 is constructed of a metallic material.

Figure 2E:
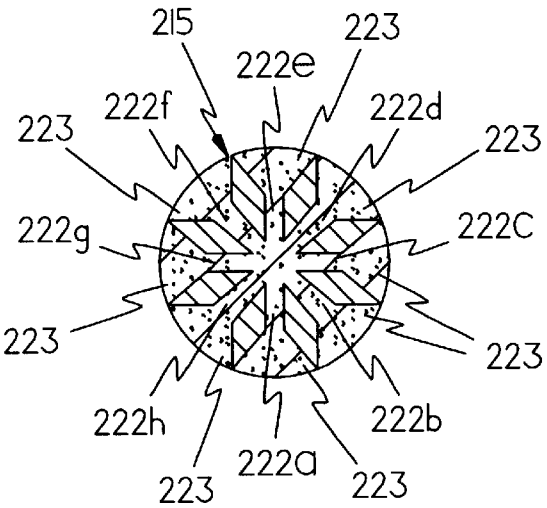
Figure 2D:
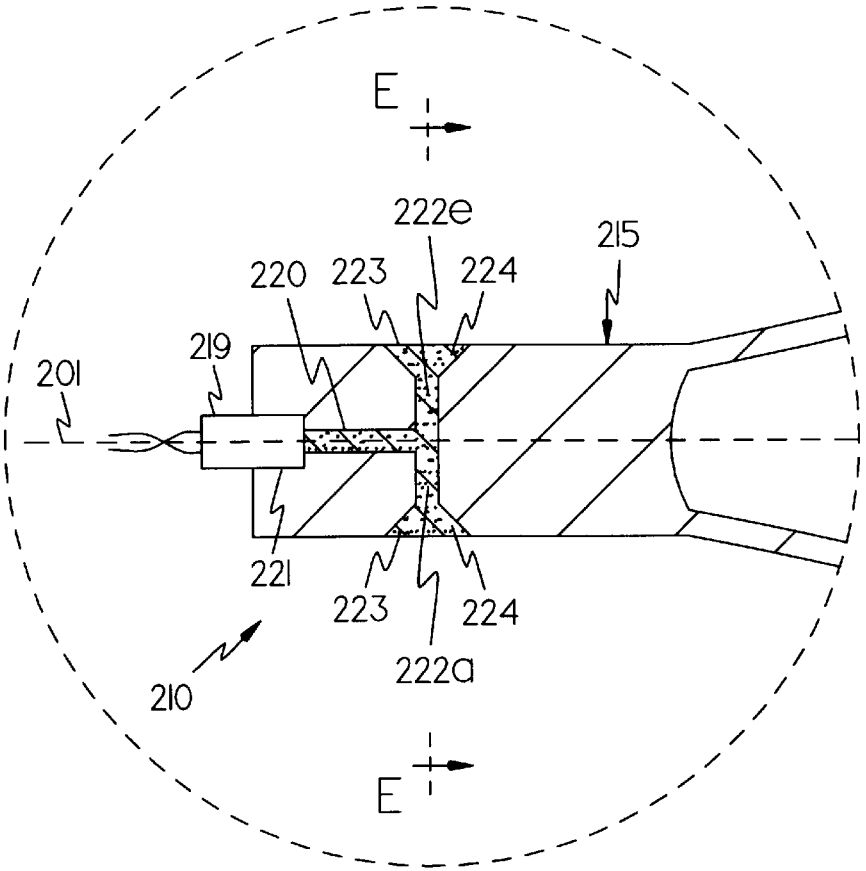

Further details of liner 200 are illustrated in the cross sectional views illustrated in FIGS. 2C–D. FIG. 2C is cross-section view of liner 200 across section lines C—C of FIG. 2B. FIG. 2D is a magnified portion of tail end section 210 illustrated in FIG. 2C. FIG. 2E is a cross-sectional view as viewed from section lines E—E of FIG. 2D.

As is particularly illustrated in FIG. 2C, tail end section 210 is generally depicted as a cylindrically shaped solid cylinder having a small diameter bore hole 220 centrally aligned with longitudinal reference axis 201. At the extremity of bore hole 220 is a larger diameter hole 221, intended to receive a detonator in the experimental version of the invention, in coaxial alignment with bore hole 220. In the final embodiment of the invention for use in weapons systems, the tail end section would end flush with the bore hole 220 containing the PIC, and the detonator (either of the EBW or Exploding Foil Initiator (EFI) type) would be placed in contact with the PIC by a variety of means.

As is more specifically shown in FIGS. 2D and 2E, eight (8) spoke-like apertures illustrated as holes 222*a–h* are radially and symmetrically disposed about reference axis 201, and which extend from exterior surface 215 of tail end section 210 to the common intersection of each of the spokes 222*a–h* and in communication therewith. At the interface of each spoke 222*a–h* with exterior surface 215 of tail end section 210 is a conically shaped counter-sink hole 223.

In one embodiment of the invention, each of the spokes 222*a–h* and its associated counter sink holes 223 are advantageously filled with an explosive charge 224 similar to explosive charge 120 of the prior art. Further, PIC bore hole 220, in communication with each of the spokes 222*a–h*, is also contiguously filled with an explosive charge 224. Explosive charge 224, is an extrudable explosive such as PBXN-301 or 80% PETN ($C_5H_8N_4O_{12}$) plus 20% silicone rubber, or any other similar extrudable (putty-like) high explosive.

Further, the arrangement of PIC bore hole 220 and detonator hole 221 may be provided with an exploding bridge wire (EBW) so as to provide a means for initially igniting explosive charge 224 contained within bore hole 220, and in turn igniting the explosive charge 224 within each of the spoke-like holes 222*a–h* in a manner as will be subsequently described below.

Referring now particularly to FIG. 2C, forward trumpet section 211 is generally defined by interior surface potions 245 and exterior surface portions 246 which define a thin-walled forward facing trumpet 249. For the most part, forward trumpet section 211 is similar in form to shaped liner 140 of the prior art. However, in the present invention, forward trumpet section 211 is integral with tail end section 210 to form a one piece structure. The integration of the forward trumpet section 211 and tail end section 210 allows an improved ability to manufacture a shaped charge being highly symmetrical and concentric with reference axis 201 so as to avoid the drawbacks inherent in the prior art.

It should be noted that the forward thin wall section may have a variety of shapes in addition to the trumpet shape shown herein. In particular a conical, hemispherical, bell, or tulip-shaped surface may be used. There are, of course, many possible shapes within the meaning as used herein, all of which may be combined with the tail end section to achieve the same high degree of concentricity between the initiation mechanism and the shaped charge liner as discussed herein. The specific shape selected for the forward thin wall section is dependent upon the intended use of the metal jet produced by the shaped charge warhead.

In one embodiment of the invention, liner 200 is formed from a solid body of a selected metallic material such as copper. In the alternative, liner 200 may be a one piece structure constructed of a tail end section 210 formed from a solid metallic body which is welded, fused, fastened, or otherwise joined together with a separate thin walled forward section 211 also formed from a solid body of like kind or different metallic material.

An exemplary shaped charge liner 200, in accordance with the present invention, has an overall length of 195 mm, a forward trumpet section 211 having a diameter of 150 mm and length of 150 mm, and a cylindrical tail end section 210 having a diameter of 23 cm and length of 45 cm. The explosive charge 224 within the holes defined by apertures 222*a–h*, and each countersink hole 223 is extrudable explosive PBXN-301, and the main explosive charge 330 is LX-14, pressed explosive. In the alternative, a cast explosive such as PBXN-110, which consists of 88% HMX and 12% various other materials may be used advantageously to avoid applying a high pressure to the tail end section.

In operation of the shaped charge explosive warhead assembly 300, the detonator 219 initiates firing of explosive charge 224 within PIC hole 220. In turn, explosive charge 224 within each of the apertures 222*a–h* is substantially simultaneously ignited to create a uniform and concentric ignition of explosive charge 330 surrounding the tail end section 210 and exterior surface 246 of forward trumpet section 211. By virtue of the uniformly spherical detonations outwardly extending from each of the spokes 222*a–h*, a highly concentric detonation of the explosive charge 330 is created, composed of eight (8) interacting detonation waves from each of the apertures. The axial symmetry of the combined detonation wave is limited, of course, by the eight (8)-fold symmetry created by the eight separate detonation waves. The interaction of these eight separate waves is such as to cause axial symmetry to be more nearly approached as propagation of the wave proceeds. This detonation wave and acts upon the forward end section 211 of liner 200, causing collapse of the thin-wall liner to occur with eight-fold symmetry approaching rotational (axial) symmetry. In turn, a metal jet is created for target penetration.

One method of constructing shaped charge liner 200 from a single body of material is as follows:

(i) A preform for liner 200 is forged beginning with an extra long starting bar, and a suitable die to accommodate tail end section 210.

(ii) The preform is held in a vacuum chuck (the exterior surface 246 having been rough machined to allow the part to be held securely,) and the liner interior surface 245 is machined to its final contour.

(iii) The partially machined liner 200 is placed on a vacuum mandrel securely holding the finished inside contour 245, and the final outside contour 246, along with the outside diameter of tail end section 210, is machined. Such a process ensures that tail end section 210 and the outside contour of liner 200 will be concentric to within a very small tolerance.

(iv) Central PIC bore hole 220 and detonator hole 221 are drilled.

(v) Eight spoke apertures 222*a–h*, being highly symmetrical and concentric with reference axis 201 of liner 200, are cross drilled, and then countersunk so as to form the conical openings 223. The above-described third(iii), fourth(iv), and fifth(v) steps are intended to be carried out without operator intervention by a computer-controlled precision machining center, ensuring that critical features of liner 200 will be in a correct relationship to each other; that is, in concentric alignment about axis 201.

(vi) After the part has been removed from the mandrel, a tight-fitting sleeve is placed over tail end section 210 and each conical opening 223 of each spoke aperture 222*a–h*. PBXN-301 is then forced under high pressure into the detonator hole 221, thereby filling the PIC hole 220, the eight spoke aperture holes 222*a–h*, and the eight counter sink holes 223, in an injection molding-like process. The tight-fitting sleeve includes eight small bleed holes aligned with the spoke apertures which allow, during the filling process, air and excess PBXN-301 explosive to escape therefrom.

(vii) When the PBXN-301 explosive is observed issuing from the sleeve bleed holes, the high pressure is relieved and filling is complete. The sleeve is then removed from tail end section 210 and a flush explosive surface is obtained at the conical openings 223 of each spoke aperture 222*a–h*.

(viii) The PBXN-301 explosive is removed from detonator hole 221, to accommodate placement of the EBW detonator.

The final fabrication steps of shaped charge warhead assembly 300 are as follows:

(i) After the PBXN-301 explosive 224 has been allowed to cure, the main explosive charge 330 is loaded or formed over liner 200. The method of loading depends upon the type of explosive being used for explosive charge 330, for example, LX-14. For this type of material, a pre-billet is pressed using a high pressure hydraulic press over a cavity mandrel conforming to the shape of the exterior contour of liner 200 generally indicated in FIG. 3 by numeral 317 to generally form the charge cavity 335. This contour 317 specifically matches surface 246 of forward trumpet section 211 but not including the tail end section 210. In turn, the pre-billet is then bored to accommodate the tail end section 210 of liner 200. The resultant pre-billet is therefore essentially a right circular cylindrical body of explosive charge with internal contoured cavity to matingly accommodate liner 200 as is particularly illustrated in FIG. 3.

(ii) Liner 200 is placed on a support mandrel conforming to the interior contour, and placed within the pre-billet cavity. The pre-billet is then re-pressed to ensure complete consolidation against the liner exterior contour. During this process, the detonator hole 221 is filled with a metal plug (not shown) to prevent re-extrusion of the explosive charge 224 during subsequent processing. If the pre-billet has been pressed shorter than the length of the liner 200, then an annular punch must be used to allow the punch to fit over the tail end section 210 during re-pressing. This procedure is recommended to prevent permanent deformation of the tail end section due to pressing forces.

(iii) Finally, the explosive pre-billet is machined to the intended final shape so as to partially expose a portion of tail end section 210 indicated by numeral 307 illustrated in FIG. 3. In turn, the plug is removed from the detonator hole, and the shaped charge explosive warhead assembly 300 is ready for use.

Shaped charge explosive warhead assembly 300 in accordance with the present invention establishes a precise PIC/booster center relative to both explosive charge 330 and forward trumpet section 211, and thereby establishes a high degree of detonation wave concentricity to enhance formation of the metal jet and subsequent target penetration.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

More specifically, explosive materials for explosive charge 224 and explosive charge 330 may be chosen from a wide array of materials to serve the intended purpose. The material selected for liner 200, likewise, may be selected from a wide array of metallic materials and alloys to serve the intended function and accommodate manufacturing processing to achieve the integral structure as indicated herein. Lastly, liner member 200 and specifically the shape of forward trumpet section 211 may have many possible configurations. These and other modifications are all intended to be within the true spirit and scope of the present invention.

What is claimed is:

1. A shaped charge explosive warhead in which a metal jet penetrator is explosively formed from a one-piece shaped charge liner, the shaped charge explosive warhead comprising a one-piece shaped charge liner including a forward thin wall section, said section having wall portions configured so as to mate with a main charge explosive cavity, said one-piece shaped charge liner including an elongated tail end section, there being a common longitudinal axis of symmetry of said tail end section and forward thin wall section; and wherein said elongated tail end section includes a central bore hole extending partially through said elongated tail end section and aligned with said longitudinal axis of symmetry, and a plurality of radial spoke-like apertures symmetrically disposed about said longitudinal axis of symmetry, wherein said radial apertures are in communication with said central bore hole, and an explosive initiation charge is contained within each of said radial apertures and said central bore hole.

2. The shaped charge explosive warhead of claim 1 wherein said one-piece shaped charge liner comprises a metal liner.

3. The shaped charge explosive warhead of claim 1 wherein said one-piece shaped charge liner comprises a copper liner.

4. The shaped charge explosive warhead of claim 1 further including a detonator coupled to said explosive initiation charge.

5. The shaped charge explosive warhead of claim 1 wherein said explosive initiation charge comprises an extrudable explosive.

6. The shaped charge explosive warhead of claim 4 wherein said explosive initiation charge comprises an extrudable explosive.

7. The shaped charge explosive warhead of claim 6 wherein said one-piece shaped charge liner comprises a metal liner.

8. The shaped charge explosive warhead of claim 1 wherein said thin wall forward section has a selected contour in the form of an outwardly concave circular arc.

9. A method of making a shaped charge explosive warhead assembly, comprising the steps of:

forming a one-piece shaped charge liner including a forward thin wall section and a tail end section having a common longitudinal axis symmetry, wherein said forward thin wall section includes a trumpet shape, and said tail end section includes a plurality of symmetrically located spoke-like apertures extending radially from said longitudinal axis of symmetry and outwardly through said tail end section, and said tail end section further includes a bore hole extending from an end surface of said tail end section to a common intersection of said spoke-like apertures and in communication with said spoke-like apertures;

filling said spoke-like apertures and said central bore hole with an explosive initiation charge; and surrounding said forward thin wall section and at least portions of said tail end section with a main explosive charge in communication with said explosive initiation charge.

10. The method of claim 9 wherein said forward thin wall section is constructed from copper material.

11. The method of claim 10 wherein said explosive initiation charge comprises an extrudable explosive.

12. The method of claim 9 wherein said forward thin wall section is constructed from metal.

13. A shaped charge explosive warhead assembly, the shaped charge explosive warhead assembly comprising:

a one-piece shaped charge liner including a forward thin wall section and a tail end section having a common longitudinal axis of symmetry, said forward thin wall section having a trumpet shape, and said tail end section including a plurality of symmetrically located spoke-like apertures extending radially from said longitudinal axis of symmetry and outwardly through said tail end section, and said tail end section further including a bore hole extending from an end surface of said tail end section to a common intersection of said spoke-like apertures and in communication with said spoke-like apertures;

an explosive initiation charge within said spoke-like apertures and at least a portion of said bore hole;

a main explosive charge surrounding and in contact with exterior surfaces of said forward thin section wall forming said trumpet shape, and at least portions of said tail end section such that said explosive initiation is in communication with said main explosive charge; and a detonator proximate said explosive initiation charge.

14. The shaped charge explosive warhead of claim 13 wherein said forward thin wall section comprises copper material.

15. The shaped charge explosive warhead of claim 13 wherein said explosive initiation charge comprises an extrudable explosive.

16. The shaped charge explosive warhead of claim 14 wherein said explosive initiation charge comprises an extrudable explosive.

17. The shaped charge explosive warhead of claim 13 wherein said forward thin wall section comprises metal.

* * * * *